US011957163B2

(12) United States Patent
Alderman et al.

(10) Patent No.: US 11,957,163 B2
(45) Date of Patent: Apr. 16, 2024

(54) MULTI-SEGMENT FILTER ELEMENT INCLUDING SMOKE-ALTERING FLAVORANT

(71) Applicant: R.J. Reynolds Tobacco Company, Winston-Salem, NC (US)

(72) Inventors: Steven Lee Alderman, Lewisville, NC (US); Leigh Ann Blevins Joyce, Lewisville, NC (US); Stephen Benson Sears, Siler City, NC (US); Kenneth Allen Beard, Lexington, NC (US); Timothy Brian Nestor, Advance, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 299 days.

(21) Appl. No.: 16/743,555

(22) Filed: Jan. 15, 2020

(65) Prior Publication Data

US 2020/0146340 A1 May 14, 2020

Related U.S. Application Data

(63) Continuation of application No. 13/082,908, filed on Apr. 8, 2011, now Pat. No. 10,609,955.

(51) Int. Cl.
*A24D 3/04* (2006.01)
*A24B 3/14* (2006.01)
(Continued)

(52) U.S. Cl.
CPC ..... *A24D 3/048* (2013.01); *A24B 3/14* (2013.01); *A24D 3/061* (2013.01); *A24D 3/08* (2013.01);
(Continued)

(58) Field of Classification Search
CPC ..... A24D 3/048; A24F 42/60
(Continued)

(56) References Cited

U.S. PATENT DOCUMENTS 2,001,709 A * 5/1935 Davidson ..... A24D 3/0245 156/227
2,881,770 A 4/1959 Touey
(Continued)

FOREIGN PATENT DOCUMENTS

EP 0 579 410 A1 1/1994
EP 0 608 047 A2 7/1994
(Continued)

OTHER PUBLICATIONS

Gardner et al., "A Safer Cigarette", *Inhalation Toxicology*, 2000, pp. 1-48, vol. 12, Supp. 5.
(Continued)

*Primary Examiner* — Michael J Felton
(74) *Attorney, Agent, or Firm* — Womble Bond Dickinson (US) LLP

(57) ABSTRACT

The invention provides an article, such as an aerosol-generating smoking article that does not combust tobacco, that includes a tobacco rod and a filter element connected to the tobacco rod, the filter element having an end proximal to the tobacco rod and an end distal from the tobacco rod, wherein the filter element includes a first section of filter material and a second section of filter material, and further includes a smoke-altering flavorant.

11 Claims, 5 Drawing Sheets

(51) Int. Cl.

| | |
|---|---|
| ***A24D 3/06*** | (2006.01) |
| ***A24D 3/08*** | (2006.01) |
| ***A24D 3/10*** | (2006.01) |
| ***A24D 3/17*** | (2020.01) |
| ***A24F 42/60*** | (2020.01) |

(52) U.S. Cl.
CPC ..... *A24D 3/10* (2013.01); *A24D 3/17* (2020.01); *A24F 42/60* (2020.01)

(58) Field of Classification Search
USPC ..... 131/341, 339, 338, 342, 344, 345, 201, 131/202, 10, 261, 207
See application file for complete search history.

(56) References Cited

U.S. PATENT DOCUMENTS 3,101,723 A 8/1963 Seligman
3,236,244 A 2/1966 Irby, Jr. et al.
3,311,519 A 3/1967 Touey et al.
3,313,306 A 4/1967 Berger et al.
3,347,247 A 10/1967 Lloyd
3,349,780 A 10/1967 Sublett et al.
3,370,595 A 2/1968 Davis et al.
3,413,982 A 12/1968 Sublett et al.
3,424,172 A 1/1969 Neurath et al.
3,551,256 A 12/1970 Watson
3,860,011 A 1/1975 Norman
3,972,335 A 8/1976 Tiggelbeck et al.
4,182,348 A 1/1980 Seehofer et al.
4,281,671 A * 8/1981 Bynre ..... A24D 3/0212 428/375
4,317,460 A 3/1982 Dale et al.
4,714,082 A 12/1987 Banerjee et al.
4,756,318 A 7/1988 Clearman et al.
4,771,795 A 9/1988 White et al.
4,793,365 A * 12/1988 Sensabaugh, Jr. ..... A24D 1/22 131/194
4,807,809 A * 2/1989 Pryor ..... A24C 5/18 493/42
4,811,745 A 3/1989 Cohen et al.
4,819,665 A 4/1989 Roberts et al.
4,862,905 A 9/1989 Greene, Jr. et al.
4,874,004 A 10/1989 Borowski et al.
4,889,144 A 12/1989 Tateno et al.
4,917,128 A 4/1990 Clearman et al.
4,920,990 A 5/1990 Lawrence et al.
4,924,886 A 5/1990 Litzinger
4,956,330 A 9/1990 Elliott et al.
4,966,171 A 10/1990 Serrano et al.
4,972,853 A * 11/1990 Brackmann ..... G11B 15/43 131/339
4,986,287 A 1/1991 Schneider et al.
5,012,829 A 5/1991 Thesing et al.
5,025,814 A 6/1991 Raker
5,027,836 A 7/1991 Shannon et al.
5,074,320 A 12/1991 Jones, Jr. et al.
5,101,839 A 4/1992 Jakob et al.
5,105,835 A 4/1992 Drewett et al.
5,105,838 A 4/1992 White et al.
5,211,684 A 5/1993 Shannon et al.
5,225,277 A 7/1993 Takegawa et al.
5,240,014 A 8/1993 Deevi et al.
5,258,340 A 11/1993 Augustine et al.
5,275,859 A * 1/1994 Phillips ..... A24D 3/08 131/332
5,365,951 A 11/1994 Arterbery et al.
5,396,909 A 3/1995 Gentry et al.
5,396,911 A * 3/1995 Casey, III ..... A24B 15/165 131/194
5,404,890 A 4/1995 Gentry et al.
5,509,429 A 4/1996 Brackmann
5,549,125 A * 8/1996 White ..... A24D 3/043 131/342
5,568,819 A 10/1996 Gentry et al.
5,595,577 A 1/1997 Bensalem et al.
5,622,190 A 4/1997 Arterbery et al.
5,692,525 A * 12/1997 Counts ..... A24F 47/008 131/194
5,718,250 A 2/1998 Banerjee et al.
5,727,571 A 3/1998 Meiring et al.
5,730,160 A 3/1998 Schneider
5,819,751 A 10/1998 Barnes et al.
5,839,449 A 11/1998 Banerjee et al.
5,909,736 A 6/1999 Stavridis et al.
5,913,311 A * 6/1999 Ito ..... A24D 3/10 131/332
5,979,459 A 11/1999 Schneider
6,095,152 A 8/2000 Beven et al.
6,503,475 B1 1/2003 McCormick et al.
6,772,768 B2 * 8/2004 Xue ..... A24D 3/064 131/200
6,814,786 B1 * 11/2004 Zhuang ..... A24D 3/048 131/202
6,863,074 B2 3/2005 Xue et al.
7,011,096 B2 3/2006 Li et al.
7,152,609 B2 12/2006 Li et al.
7,165,553 B2 1/2007 Luan et al.
7,228,862 B2 6/2007 Hajaligol et al.
7,240,678 B2 7/2007 Crooks et al.
7,509,961 B2 3/2009 Saoud et al.
7,549,427 B2 6/2009 Dellinger et al.
7,560,410 B2 7/2009 Pillai et al.
7,566,681 B2 7/2009 Bock et al.
7,726,320 B2 * 6/2010 Robinson ..... H05B 3/42 131/200
7,827,997 B2 11/2010 Crooks et al.
7,856,990 B2 * 12/2010 Crooks ..... A24D 3/043 131/334
8,375,958 B2 2/2013 Hutchens
8,434,498 B2 5/2013 Sebastian
8,613,284 B2 12/2013 Hutchens
8,997,755 B2 4/2015 Norman et al.
2002/0014453 A1 2/2002 Lilly, Jr. et al.
2002/0166563 A1 11/2002 Jupe et al.
2003/0000538 A1 1/2003 Bereman
2003/0106562 A1 6/2003 Chatterjee
2003/0159703 A1 * 8/2003 Yang ..... A24D 1/002 131/335
2004/0261807 A1 12/2004 Dube et al.
2005/0066981 A1 3/2005 Crooks et al.
2005/0066986 A1 3/2005 Nestor et al.
2005/0274390 A1 12/2005 Banerjee et al.
2006/0090769 A1 5/2006 Woodson et al.
2006/0174901 A1 8/2006 Karles et al.
2006/0180164 A1 8/2006 Paine, III et al.
2006/0219253 A1 10/2006 Branton et al.
2007/0056600 A1 3/2007 Coleman, III et al.
2007/0215168 A1 9/2007 Banerjee et al.
2007/0251658 A1 11/2007 Gedevanishvili et al.
2008/0295853 A1 12/2008 Jones
2009/0038628 A1 2/2009 Shen et al.
2009/0277465 A1 11/2009 Karles et al.
2010/0065075 A1 3/2010 Banerjee et al.
2010/0108084 A1 5/2010 Norman et al.
2010/0122708 A1 5/2010 Sears et al.
2010/0125039 A1 5/2010 Banerjee et al.
2011/0108011 A1 5/2011 Norman et al.
2011/0120481 A1 5/2011 Besso et al.
2012/0080043 A1 * 4/2012 Naenen ..... A24D 3/0216 131/341

FOREIGN PATENT DOCUMENTS

EP 0 628 260 A2 8/1994
EP 0 664 964 A2 8/1995
EP 0 783 841 A1 7/1997
GB 625391 6/1949
GB 2 271 709 4/1994
WO WO 2003/009711 A1 2/2003
WO WO 2003/047836 A1 6/2003
WO WO 2003/092416 A1 11/2003

(56) References Cited

FOREIGN PATENT DOCUMENTS

| | | | |
|---|---|---|---|
| WO | WO 2005/023026 | A1 | 3/2005 |
| WO | WO 2005/032287 | | 4/2005 |
| WO | WO 2006/051422 | A1 | 5/2006 |
| WO | WO 2006/064371 | A1 | 6/2006 |
| WO | WO 2006/103404 | A1 | 10/2006 |
| WO | WO 2011/060008 | | 5/2011 |

OTHER PUBLICATIONS

Colin L. Browne, The Design of Cigarettes, pp. vii-viii, 1-2 & 67-70 (3d edition, 1990).

* cited by examiner

MULTI-SEGMENT FILTER ELEMENT INCLUDING SMOKE-ALTERING FLAVORANT

FIELD OF THE INVENTION

The present invention relates to products made or derived from tobacco, or that otherwise incorporate tobacco, and are intended for human consumption. In particular, the invention relates to filter elements for smoking articles such as cigarettes.

BACKGROUND OF THE INVENTION

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in *Tobacco Production, Chemistry and Technology*, Davis et al. (Eds.) (1999). A smoker employs a cigarette by lighting one end thereof and burning the tobacco rod. The smoker then receives mainstream smoke into his/her mouth by drawing on the opposite end (e.g., the filter end) of the cigarette.

Activated carbon particles or other adsorbent materials, such as silica gel, can be incorporated into a cigarette filter. Exemplary cigarettes and filters therefor are described in U.S. Pat. No. 3,353,543 to Sproull et al. and U.S. Pat. No. 4,481,958 to Ranier et al., and in PCT WO 02/37990 to Bereman. Certain commercially available filters have particles or granules of carbon (e.g., an activated carbon material or an activated charcoal material) dispersed within a fibrous material, such as described in U.S. Pat. No. 6,584,979 to Xue et al. Other commercially available filters have so-called "compartment filter" or "triple filter" designs, such as those filters described in U.S. Pat. No. 4,163,452 to Green et al.; U.S. Pat. No. 5,129,408 to Jakob et al.; and U.S. Pat. No. 6,537,186 to Veluz; as well as U.S Patent Application Publication No. 2003/0106562. European Patent Application 0 579 410 A1 describes a filter including an annular section of carbon particles surrounding a cellulose acetate filter section. U.S. Pat. No. 5,360,023 to Blakley et al. describes a filter comprising a gathered paper that includes a carbonaceous material. Adsorbent materials incorporated into a cigarette filter can be used as a substrate for functional groups, such as described in U.S. Pat. No. 6,481,442 to Dyakonov et al. and U.S. Pat. No. 6,595,218 to Koller et al. Flavorants can be added to activated carbon as described in US Pat. App. Pub. No. 2003/0159703. Exemplary commercially available filters are available as SCS IV Dual Solid Charcoal Filter from American Filtrona Corp.; Triple Solid Charcoal Filter from FIL International, Ltd.; Triple Compartment Filter from Baumgartner; and ACT from FIL International, Ltd.

Cigarette filter elements that incorporate carbon have a propensity to remove certain gas phase components from the mainstream smoke that passes through the filter element during draw by the smoker. Interaction of mainstream smoke with adsorbent substances, such as carbon particles, results in a certain degree of removal of certain gas phase compounds from the smoke. Such a change in the character of the smoke can result in changes in the sensory properties of the smoke. For example, mainstream tobacco smoke that is filtered using a conventional cigarette filter element incorporating carbon can often be characterized as having slightly metallic, drying, and powdery flavor characteristics.

It would be desirable to provide a cigarette filter element that efficiently removes significant amounts of certain gas phase components of mainstream cigarette smoke. It would also be desirable to provide a cigarette filter that removes gas phase components of mainstream smoke while still yielding smoke with desirable sensory characteristics.

SUMMARY OF THE INVENTION

The present invention relates to filtered smoking articles possessing filter elements. The nature, form, or type of smoking article can vary. Exemplary smoking articles include those in the form of a cigarette or an aerosol-generating smoking article that does not combust tobacco.

More particularly, the invention provides cigarettes comprising a tobacco rod and a filter element connected to the tobacco rod such that the filter element has an end proximal to the tobacco rod and an end distal from the tobacco rod. The filter element can comprise, in various embodiments, a filter material with one or more tubes inserted into and extending at least partially longitudinally through the filter material. The one or more tubes each define a channel adapted for passage of mainstream smoke from the tobacco rod at least partially longitudinally through the filter material. The filter material preferably includes a smoke-altering material beginning at the end proximal to the tobacco rod and extending at least partially longitudinally along the filter element. The smoke-altering material is useful for removing various vapor-phase compounds from the mainstream smoke. The one or more tubes or channels are useful to allow a certain content of mainstream smoke to proceed through the filter element without contacting the smoke-altering material. This provides a content of mainstream smoke to the user with substantially unaltered taste and other sensory characteristics that can be desired.

In certain embodiments, cigarettes according to the invention can include a filter element comprising a first longitudinally extending section of filter material proximal to the tobacco rod, the first section of filter material comprising the smoke-altering material therein. The filter element also can comprise a second longitudinally extending section of filter material distal from the tobacco rod and arranged in an end-to-end configuration with the first section of filter material. The first section of filter material can comprise one or more channels extending through the first section of filter material, wherein the one or more channels are adapted for passage of mainstream smoke between said tobacco rod and said second section of filter material. In specific embodiments, the channels can be pre-formed tubes that are inserted into the section of filter material to define the passage therethrough. In other embodiments, one or more channels may be formed in the section of filter material during manufacture of the filter itself.

The channels or tubes in the section of filter material can take on a variety of shapes and dimensions. For example, the channels or tubes can have a cross-sectional shape that is rectangular or circular. In certain embodiments, the number of channels or tubes in the section of filter material can be 1 to about 20. The channels or tubes preferably have an internal diameter of at least about 0.25 mm, more preferably at least about 0.5 mm. In specific embodiments, each of the one or more channels or tubes can have an internal diameter of about 0.25 mm to about 2 mm. Further, the one or more channels or tubes can have a total cross-sectional area of about 0.1 $mm^2$ to about 50 $mm^2$. When tubes are used, it can be desirable for the walls of the tubes to have a thickness of about 0.1 mm to about 1 mm. In some embodiments, the walls of the tubes can be porous. For example, the tube walls can have a sufficient porosity such that at least a portion of the mainstream smoke permeates through the tube walls and into the section of filter material surrounding the tube. In specific embodiments, tube walls can be formed of cellulose acetate, polyethylene, polypropylene, polylactic acid (PLA), polyhydroxyalkanoate (PHA), or a combination thereof. Other polymers recognized as suitable for formation of components of a cigarette filter may also be used. Positioning of the channels or tubes can vary. For example, the channels or tubes can be proximal to the central axis of the section of filter material, or they can be positioned around the circumference of the filter element. Alternately, the tubes could be randomly spaced within the filter material.

The filter material used to form the one or more sections of the filter element can vary. In some embodiments, the filter can be selected from the group consisting of cellulose acetate tow, gathered cellulose acetate web, polypropylene tow, gathered polypropylene web, gathered polyester web, gathered paper, and strands of reconstituted tobacco. Other polymers, including PLA and PHA also could be used. In specific embodiments, a first section of filter material and a second section of filter material both comprise cellulose acetate tow. The filter element can have an overall length of about 15 mm to about 65 mm. In embodiments comprising two sections of filter material, it can be desirable for the section of filter material proximal to the tobacco rod to be of greater length than the section of filter material distal to the tobacco rod. For example, the section of filter material proximal to the tobacco rod can have a length of about 5 mm to about 40 mm, preferably about 10 mm to about 30 mm. The section of filter material distal to the tobacco rod can have a length of about 2 mm to about 25 mm, preferably about 5 mm to about 15 mm. In other embodiments, the relative lengths of the sections of filter material may be reversed.

The filter materials can comprise a variety of components useful for altering a characteristic of the smoke passing therethrough. For example, the filter element can include at least one breakable capsule. Preferably, such breakable capsule is positioned within the filter material. In some embodiments, such breakable capsule can be positioned within the channel of at least one of the one or more tubes. Likewise, the tube walls may be formed to include a flavorant or other material useful for altering one or more characteristics of the mainstream smoke passing therethrough. For example, the tubes may include one or more filter materials.

A variety of smoke-altering materials can be included in the filter element. For example, the smoke-altering material can be an adsorbent. In some embodiments, such adsorbent can be selected from the group consisting of activated carbon, molecular sieves, clays, activated aluminas, silica gels, ion exchange resins, metal organic frameworks (MOF), molecularly imprinted polymers (MIP), flavorants, and combinations thereof. Preferably, the adsorbent is activated carbon, such as activated carbon with a carbon tetrachloride adsorption of at least about 80%. Moreover, the adsorbent can be in granular form, such as having a particle size such that at least about 80% of the particles are from 20 to 50 mesh. In other embodiments, the smoke-altering material can be an oxidation catalyst. For example, the oxidation catalyst can be a catalytic metal compound comprising an element selected from the group consisting of alkali metals, alkaline earth metals, transition metals in Groups IIIB, IVB, VB, VIB VIIB, VIIIB, IB, and IIB, Group IIIA elements, Group IVA elements, lanthanides, and actinides. More specifically, the catalytic metal compound can be selected from the group consisting of iron oxide, copper oxide, zinc oxide, cerium oxide, palladium, platinum, rhodium, halides of palladium, platinum or rhodium, nitrates of palladium, platinum or rhodium, and combinations thereof. In specific embodiments, the smoke-altering material can be in powdered or granular form and can be imbedded in a fibrous tow filter material.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist the understanding of embodiments of the invention, reference will now be made to the appended drawings, in which like reference numerals refer to like elements and which are not necessarily drawn to scale. The drawings are exemplary only, and should not be construed as limiting the invention.

DETAILED DESCRIPTION OF THE PREFERRED EMBODIMENTS

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. It must be noted that, as used in this specification, the singular forms "a," "an," and "the" include plural referents unless the context clearly dictates otherwise.

Figure 1:
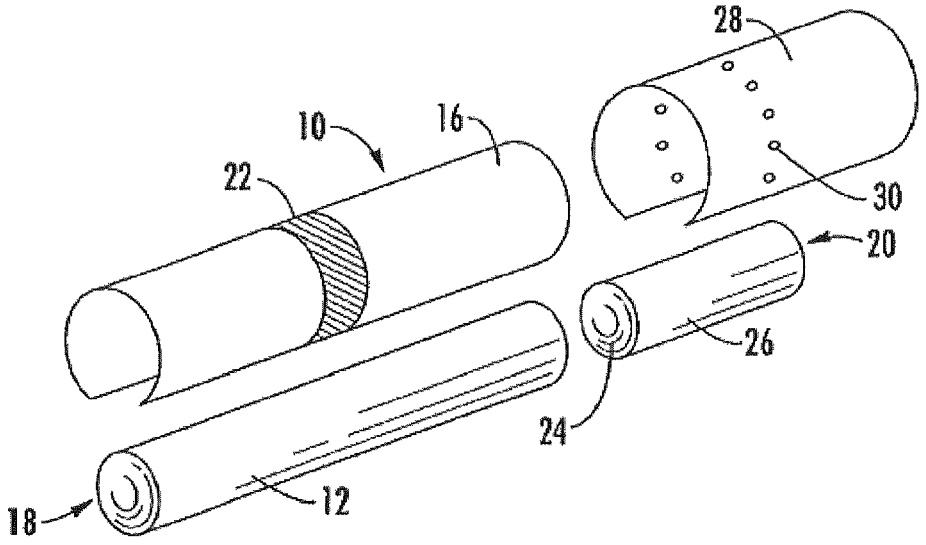
FIG. 1 is an exploded perspective view of a smoking article having the form of a cigarette, showing the smokable material, the wrapping material components, and the filter element of the cigarette.

The present invention is directed to filter elements adapted for use in filtering mainstream smoke generated by smoking articles, such as cigarettes or "heat but not burn" cigarette alternatives, wherein the filter elements contain at least one adsorbent material. Referring to FIG. 1, a smoking article 10 in the form of a cigarette is shown. The cigarette 10 includes a generally cylindrical rod 12 of a charge or roll of smokable filler material contained in a circumscribing wrapping material 16. The rod 12 is conventionally referred to as a "tobacco rod". The ends of the tobacco rod are open to expose the smokable filler material. One end of the tobacco rod 12 is the lighting end 18 and a filter element 20 is positioned at the other end. The cigarette 10 is shown as having one optional printed band 22 on wrapping material 16, and that band circumscribes the cigarette rod in a direction transverse to the longitudinal axis of the cigarette. That is, the band provides a cross-directional region relative to the longitudinal axis of the cigarette. The band can be printed on the inner surface of the wrapping material (i.e., facing the smokable filler material) or on the outer surface of the wrapping material. Although the cigarette shown in FIG. 1 possesses wrapping material having one optional band, the cigarette also can possess wrapping material having further optional spaced bands numbering two, three, or more.

The cigarette 10 includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod. The ends of the filter element 20 are open to permit the passage of air and smoke therethrough. The filter element 20 includes at least one segment or section of filter material 24 (e.g., plasticized cellulose acetate tow) that is overwrapped along the longitudinally extending surface thereof with circumscribing plug wrap material 26. A typical plug wrap material 26 is a paper material, such as a paper that is porous or non-porous to air flow. The filter element 20 can have two or more segments of filter material, and/or flavor additives incorporated therein. Optional embodiments may exclude the plug wrap material.

The filter element 20 is attached to the tobacco rod 12 by tipping material 28, which circumscribes both the entire length of the filter element and an adjacent region of the tobacco rod. The inner surface of the tipping material 28 is fixedly secured to the outer surface of the plug wrap 26 and the outer surface of the wrapping material 16 of the tobacco rod using a suitable adhesive. Optionally, a ventilated or air diluted smoking article is provided with an air dilution means, such as a series of perforations 30, each of which extend through the tipping material 28 and plug wrap 26. When air diluted, the filter element normally is ventilated to provide a cigarette having an air dilution between about 10 and about 85 percent, preferably about 30 to about 40 percent. As used herein, the term "air dilution" is the ratio (expressed as a percentage) of the volume of air drawn through the air dilution means to the total volume of air and smoke drawn through the cigarette and exiting the extreme mouth end portion of the cigarette. See, Selke, et al., Beitr. Zur Tabak. In., Vol. 4, p. 193 (1978). The perforations 30 can be made by various techniques known to those of ordinary skill in the art. For example, the perforations 30 can be made using mechanical or microlaser offline techniques or using online laser perforation.

Preferred cigarettes of the present invention exhibit desirable resistance to draw. For example, an exemplary cigarette exhibits a pressure drop of between about 50 and about 250 mm water pressure drop at 17.5 cc/sec. air flow. Preferred cigarettes exhibit pressure drop values of between about 60 mm and about 180 mm, more preferably between about 70 mm to about 150 mm, water pressure drop at 17.5 cc/sec. air flow. Typically, pressure drop values of cigarettes are measured using a Filtrona Filter Test Station (CTS Series) available from Filtrona Instruments and Automation Ltd or a Quality Test Module (QTM) available from the Cerulean Division of Molins, PLC.

The dimensions of a representative cigarette 10 can vary. Preferred cigarettes are rod shaped and have circumferences of about 17 mm to about 27 mm. The total length of the cigarette 10 is typically about 80 mm to about 150 mm.

The length of the filter element 20 can vary. Typical filter elements can have lengths of about 7 mm to about 65 mm, frequently about 21 to about 50 mm. The tipping paper 28 will typically circumscribe the entire filter element 20 and about 4 mm of the length of the tobacco rod 12 in the region adjacent to the filter element.

The wrapping materials used to circumferentially wrap the tobacco rod can vary. Preferably, the wrapping material is a paper material, such as the type of paper material typically used in cigarette manufacture. The wrapping material can have a wide range of compositions and properties. The selection of a particular wrapping material will be readily apparent to those skilled in the art of cigarette design and manufacture. Smokable rods can have one layer of wrapping material; or smokable rods can have more than one layer of circumscribing wrapping material, such as is the case for the so-called "double wrap" smokable rods. The wrapping material can be composed of materials, or be suitably treated, in order that the wrapping material does not experience a visible staining as a result of contact with components of the smokable material (e.g., aerosol forming material). Exemplary types of wrapping materials, wrapping material components and treated wrapping materials are described in U.S. Pat. No. 5,105,838 to White et al.; U.S. Pat. No. 5,271,419 to Arzonico et al., U.S. Pat. No. 5,220,930 to Gentry, U.S. Pat. No. 6,908,874 to Woodhead et al., U.S. Pat. No. 6,929,013 to Ashcraft et al., U.S. Pat. No. 7,195,019 to Hancock et al., U.S. Pat. No. 7,276,120 to Holmes, U.S. Pat. No. 7,275,548 to Hancock et al.; PCT WO 01/08514 to Fournier et al.; and PCT WO 03/043450 to Hajaligol et al., which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Maudit International. The porosity of the wrapping material can vary, and frequently is between about 5 CORESTA units and about 30,000 CORESTA units, often is between about 10 CORESTA units and about 90 CORESTA units, and frequently is between about 8 CORESTA units and about 80 CORESTA units.

The wrapping material typically incorporates a fibrous material and at least one filler material imbedded or dispersed within the fibrous material. The fibrous material can vary. Most preferably, the fibrous material is a cellulosic material. Preferably, the filler material has the form of essentially water insoluble particles. Additionally, the filler material normally incorporates inorganic components. The filler material may comprise catalysts or adsorbent materials capable of adsorbing or reacting with vapor phase components of mainstream smoke. Filler materials incorporating calcium salts are particularly preferred. One exemplary filler material has the form of calcium carbonate, and the calcium carbonate most preferably is used in particulate form. See, for example, U.S. Pat. No. 4,805,644 to Hampl; U.S. Pat. No. 5,161,551 to Sanders; U.S. Pat. No. 5,263,500 to Baldwin et al.; and PCT WO 01/48316. Other filler materials include agglomerated calcium carbonate particles, calcium tartrate particles, magnesium oxide particles, magnesium hydroxide gels; magnesium carbonate-type materials, clays, diatomaceous earth materials, titanium dioxide particles, gamma alumina materials and calcium sulfate particles. The filler can be selected so as to impart certain beneficial characteristics to the wrapping material, such as modification of combustion properties or the ability to adjust the character and content of mainstream smoke (e.g., by adsorption of certain compounds). In some embodiments, a filler material may be optional.

The production of filter rods, filter rod segments and filter elements, and the manufacture of cigarettes from those filter rods, filter rod segments and filter elements, can be carried out using the types of equipment known in the art for such uses. Multi-segment cigarette filter rods can be manufactured using a cigarette filter rod making device available under the brand name Mulfi from Hauni-Werke Korber & Co. KG. Six-up rods, four-up filter rods and two-up rods that are conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; and U.S. Pat. No. 6,229,115 to Vos et al.

Tobacco materials useful for carrying out the present invention can vary. Tobacco materials can be derived from various types of tobacco, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so-called "blended" form. For example, certain popular tobacco blends, commonly referred to as "American blends," comprise a mixture of flue-cured tobacco, burley tobacco and Oriental tobacco. Such blends, in many cases, contain tobacco materials that have a processed form, such as processed tobacco stems (e.g., cut-rolled or cut-puffed stems) and volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3rd Ed., p. 43 (1990) and *Tobacco Production, Chemistry and Technology*, Davis et al. (Eds.) p. 346 (1999). Various representative tobacco types, processed types of tobaccos, types of tobacco blends, cigarette components and cigarette configurations are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 7,011,096 to Li et al.; and U.S. Pat. No. 7,017,585 to Li et al.; U.S. Pat. No. 7,025,066 to Lawson et al.; U.S. Pat. App. Pub. No. 2004-0255965 to Perfetti et al.; PCT WO 02/37990 to Bereman; and Bombick et al., *Fund. Appl. Toxicol.,* 39, p. 11-17 (1997); which are incorporated herein by reference.

Tobacco materials typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.5 g to about 1 g. The tobacco filler normally is employed so as to fill the tobacco rod at a packing density of about 100 mg/cm$^3$ to about 300 mg/cm$^3$, and often about 150 mg/cm$^3$ to about 275 mg/cm$^3$.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972).

One exemplary tobacco blend for use in the present invention comprises about 25 to about 98 weight percent flue-cured tobacco, about 10 to about 30 weight percent burley tobacco, about 10 to about 30 weight percent Oriental tobacco, about 10 to about 30 weight percent reconstituted flue-cured and/or Oriental tobacco leaf, about 10 to about 50 weight percent expanded flue-cured tobacco lamina, optionally about 5 to about 20 weight percent expanded flue-cured tobacco stems, and about 2 to about 8 weight percent of a casing material. Optionally, the blend may further include about 0.25 to about 2 weight percent of flavors in the form of a top dressing, preferably about 0.5 to about 1.5 weight percent. A preferred top dressing composition comprises of flavors with vapor pressures not exceeding about 2.0 mm Hg at 40° C.

In a preferred embodiment, the tobacco blend comprises about 25 to about 70 weight percent flue-cured tobacco, about 12 to about 20 weight percent burley tobacco, about 15 to about 20 weight percent Oriental tobacco, about 15 to about 20 weight percent reconstituted flue-cured and/or Oriental tobacco leaf, about 20 to about 30 weight percent expanded flue-cured tobacco lamina, optionally about 10 to about 15 weight percent expanded flue-cured tobacco stems, and a casing material in an amount of about 3 to about 5 weight percent.

The casing material preferably includes various flavoring ingredients known in the art, such as cocoa, licorice, various sugars, and glycerin. In one embodiment, the casing material includes components derived or extracted from a fig plant (e.g., Fig Supreme Flavor available from Bell Flavors, Inc.). One exemplary casing composition is disclosed in U.S. Pat. No. 5,360,023 to Blakley et al., which is incorporated by reference herein. Exemplary plant-derived compositions that could be used are disclosed in U.S. application Ser. No. 12/971,746 to Dube et al., and Ser. No. 13/015,744 to Dube et al.

The level of "tar" and nicotine delivered by the cigarettes of the invention will vary. Typically, the cigarettes of the invention will deliver the "tar" and nicotine amounts described in U.S. Pat. No. 4,836,224, which is incorporated by referenced herein. Cigarettes of this invention generally deliver from about 0.2 mg to about 3.5 mg, frequently from about 0.3 mg to about 2.5 mg, more frequently from about 0.6 mg to about 1.2 mg of nicotine when smoked under FTC smoking conditions. Cigarettes of this invention generally deliver from about 0.5 to about 18 mg, frequently from about 3 to about 13 mg, more frequently about 5 to about 11 mg "tar" when smoked under FTC smoking conditions.

The tobacco blend may contain an aerosol forming material. The aerosol forming material can vary, and mixtures of various aerosol forming materials can be used. Representative types of aerosol forming materials are set forth in U.S. Pat. No. 4,793,365 to Sensabaugh, Jr. et al.; and U.S. Pat. No. 5,101,839 to Jakob et al.; PCT WO 98/57556 to Biggs et al.; and *Chemical and Biological Studies on New Cigarette Prototypes that Heat Instead of Burn Tobacco*, R. J. Reynolds Tobacco Company Monograph (1988); which are incorporated herein by reference. A preferred aerosol forming material produces a visible aerosol upon the application of sufficient heat thereto, and a highly preferred aerosol forming material produces an aerosol that can be considered to be "smoke-like." A preferred aerosol forming material is chemically simple, relative to the chemical nature of the smoke produced by burning tobacco. A highly preferred aerosol forming material is a polyol, such as glycerin.

The amount of aerosol forming material employed relative to the dry weight of smokable material present in a smokable rod can vary. For a smokable rod, the amount of aerosol forming material present in that rod is more than about 2 percent, and generally is more than about 3 percent, of the combined dry weight of the aerosol forming material and tobacco material within that rod. For a preferred smokable rod, the amount of aerosol forming material present in that rod typically is at least about 5 percent, generally is at least about 10 percent, often is at least about 15 percent, frequently is at least about 20 percent, and even can be at least about 25 percent, of the combined dry weight of the aerosol forming material and tobacco material within that rod. For a preferred smokable rod, the amount of aerosol forming material present in that rod typically does not exceed about 65 percent, generally does not exceed about 60 percent, often does not exceed about 55 percent, and frequently does not exceed about 50 percent, of the combined dry weight of the aerosol forming material and tobacco material in that rod. Smokable materials possessing exceedingly high levels of aerosol forming material typically are difficult to process into cigarette rods using conventional types of automated cigarette manufacturing equipment.

FIGS. 2-7 illustrate various embodiments of the filter element of the invention, which is adapted for use with smoking articles such as cigarettes. The filter element of the invention typically comprises one or more longitudinally extending segments. In specific embodiments, the filter element of the invention includes 2 segments that preferably are arranged in an end-to-end configuration. In other embodiments, the filter element may comprise a single segment or may comprise 3, 4, or even further segments, including cavity filters (e.g., "plug-space-plug" filters). In one preferred embodiment, the filter element includes a tobacco end segment (i.e., a section of filter material proximal to the tobacco rod) and a mouth end segment (i.e., a section of filter material distal from the tobacco rod).

Each segment of the filter element can have varying properties and may include one or more smoke-altering materials therein. For example, certain embodiments of the invention provide a filter element where mainstream smoke is channeled through a region devoid of smoke-altering material, which prevents or reduces changes in the sensory properties of the smoke arising from contact with the smoke-altering material. The smoke-altering material may be segregated in a single segment of the filter element, and a further segment of the filter element may be substantially free of the smoke-altering materials. In other embodiments, a single segment of a filter element according to the invention may have a smoke-altering material provided only in one portion thereof. In this manner, the invention provides a filter design that enables the smoke-altering material to interact with certain gaseous species within mainstream smoke without contacting the full stream of mainstream smoke. In embodiments where three or more filter segments are included, channels or tubes may be formed in two or more of the segments.

As used herein, the term "smoke-altering material" refers to any material capable of altering the composition of mainstream smoke passing through the filter element, such as by adsorption of certain gaseous species (e.g., removal of organic compounds), by chemical reaction with certain gaseous species (e.g., oxidation of carbon monoxide), or by addition of volatile, gaseous components (e.g., addition of a flavorant to the smoke). The smoke-altering material is typically utilized in a form that can be described as powered or granular, although other forms, such as fibers or sprayed on solution monolith, could be used without departing from the invention. Combinations of smoke-altering material could be used in the same filter, including combinations of materials of different type such as a combination of an adsorbent and a flavorant.

Exemplary types of smoke-altering material include adsorbents, such as activated carbon, molecular sieves (e.g., zeolites and carbon molecular sieves), clays, activated aluminas, silica gels, and ion exchange resins, and flavorants, including flavorant-containing capsules and solid botanical additives such as peppermint or spearmint leaves or other plant-based flavorants in particulate form. The amount of adsorbent that may be used in a filter element (or a specific segment of a filter element) according to the invention can be about 10 to about 250 mg, often about 30 to about 150 mg, and frequently about 40 to about 120 mg. The form of the adsorbent may vary. Typically, the adsorbent is used in granular or particulate solid form having a particle size of between about 8×16 mesh to about 30×70 mesh using the U.S. sieve system. However, smaller or larger particles could be used without departing from the invention. In some embodiments, the adsorbent may have a particle size such that at least about 80% of the particles are from 20 to 50 mesh. The terms "granular" and "particulate" are intended to encompass both non-spherical shaped particles and spherical particles, such as so-called "beaded carbon" described in WO 03/059096 A1, which is incorporated by reference herein.

In specific embodiments, the adsorbent particularly may be activated carbon. The level of activity of the carbon may vary. Typically, the carbon has an activity of about 60 to about 150 Carbon Tetrachloride Activity (i.e., weight percent pickup of carbon tetrachloride). Activated carbon most useful herein consists primarily of carbon, and preferably has a carbon content above about 80 weight percent, and more preferably above about 90 weight percent. Preferred carbonaceous materials are provided by carbonizing or pyrolyzing bituminous coal, tobacco material, softwood pulp, hardwood pulp, coconut shells, almond shells, grape seeds, walnut shells, macadamia shells, kapok fibers, cotton fibers, cotton linters, and the like. Carbon from coconut shells, almond shells, grape seeds, walnut shells, and macadamia nut shells are particularly preferred. Examples of suitable carbonaceous materials are activated coconut hull based carbons available from Calgon Corp. as PCB and GRC-11, coal-based carbons available from Calgon Corp. as S-Sorb, BPL, CRC-11F, FCA and SGL, wood-based carbons available from Westvaco as WV-B, SA-20 and BSA-20, carbonaceous materials available from Calgon Corp. as HMC, ASC/GR-1 and SC II, and Witco Carbon No. 637, and AMBERSORB resins available from Rohm and Haas. Other carbonaceous materials are described in U.S. Pat. No. 4,771,795 to White, et al. and U.S. Pat. No. 5,027,837 to Clearman, et al.; and European Patent Application Nos. 236,922; 419,733 and 419,981. Certain carbonaceous materials can be impregnated with substances, such as transition metals (e.g., silver, gold, copper, platinum, palladium), potassium bicarbonate, tobacco extracts, polyethyleneimine, manganese dioxide, eugenol, and 4-ketononanoic acid. The carbon composition may also include one or more fillers, such as semolina. Grape seed extracts may also be incorporated into the filter element as a free radical scavenger. Exemplary ion exchange resins include DIAION® ion-exchange resins available from Mitsubishi Chemical Corp. (e.g., WA30 and DCA11), DUOLITE® ion exchange resins available from Rohm and Haas (e.g., DUOLITE® A7), and XORBEX resins available from Dalian Trico Chemical Co. of China.

In another embodiment, the smoke-altering material is an oxidation catalyst capable of oxidizing one or more gaseous species present in mainstream smoke, such as carbon monoxide, NOx, hydrogen cyanide, catechol, hydroquinone, or certain phenols. The oxidation catalyst used in the invention is typically a catalytic metal compound that oxidizes one or more gaseous species of mainstream smoke having a molecular weight of less than about 110 Da, more often less than about 75 Da, and most often less than about 50 Da or less than about 40 Da. Although not bound by any particular theory of operation, it is believed that the filter elements of the invention are particularly well-suited for oxidation of relatively small molecular weight gaseous species.

As used herein, "catalytic metal compound" refers to a metal-containing compound that can either directly react with one or more gas phase components of mainstream smoke generated by a smoking article or catalyze a reaction involving a gas phase component of mainstream smoke or both, such that concentration of the gas phase component is reduced. For example, certain catalytic metal compounds can catalyze the oxidation of CO to $CO_2$ in the presence of oxygen in order to reduce the level of CO in mainstream smoke. In U.S. Pat. App. Pub. No. 2007/0215168 to Banerjee et al., which is incorporated by reference herein in its entirety, smoking articles comprising cerium oxide particles are described. The cerium oxide particles reduce the amount of carbon monoxide emitted during use of the smoking articles. Additional catalytic metal compounds are described in U.S. Pat. No. 4,182,348 to Seehofer et al.; U.S. Pat. No. 4,317,460 to Dale et al.; U.S. Pat. No. 4,956,330 to Elliott et al.; U.S. Pat. No. 5,050,621 to Creighton et al.; U.S. Pat. No. 5,258,340 to Augustine et al.; U.S. Pat. No. 6,503,475 to McCormick; U.S. Pat. No. 6,503,475 to McCormick; U.S. Pat. No. 6,562,495 to Yadav et al.; U.S. Pat. No. 6,572,673 to Lee et al.; U.S. Pat. No. 6,709,622 to Billiet et al.; U.S. Pat. No. 6,789,548 to Bereman et al.; U.S. Pat. No. 6,848,450 to Lilly Jr., et al.; U.S. Pat. No. 7,011,096 to Li et al.; U.S. Pat. No. 7,152,609 to Li et al.; U.S. Pat. No. 7,165,553 to Luan et al.; U.S. Pat. No. 7,228,862 to Hajaligol et al.; U.S. Pat. No. 7,509,961 to Saoud et al.; U.S. Pat. No. 7,549,427 to Dellinger et al.; U.S. Pat. No. 7,560,410 to Pillai et al.; and U.S. Pat. No. 7,566,681 to Bock et al.; and U.S. Pat. App. Pub. Nos. 2005/0274390 to Banerjee et al., 2007/0251658 to Gedevanishvili et al., 2010/0065075 to Banerjee et al., 2010/0125039 to Banerjee et al., and 2010/0122708 to Sears et al., all of which are incorporated by reference herein in their entirety.

Examples of the metal component of the catalytic metal compound include, but are not limited to, alkali metals, alkaline earth metals, transition metals in Groups IIIB, IVB, VB, VIB VIIB, VIIIB, IB, and IIB, Group IIIA elements, Group IVA elements, lanthanides, and actinides. Specific exemplary metal elements include Ti, Zr, Hf, V, Nb, Ta, Cr, Mo, W, Mn, Re, Fe, Co, Ni, Ru, Rh, Pd, Os, Ir, Pt, Cu, Ag, Au, Zn, Y, Ce, Na, K, Cs, Mg, Ca, B, Al, Si, Ge, and Sn. Catalytic metal compounds can be used in a variety of solid particulate forms including precipitated metal particles, metal oxide particles (e.g., iron oxides, copper oxide, zinc oxide, and cerium oxide), monoliths, and supported catalyst particles wherein the catalytic metal compound is dispersed within or coated on a porous supporting material, such as activated carbon, aluminum oxide, copper oxide, or titanium oxide. Combinations of catalytic metal compounds can be used, such as a combination of a palladium catalyst with cerium oxide. The particle size of the catalytic metal compounds can vary, but is typically between about 1 nm to about 20 microns, with the unsupported catalyst materials typically located in the lower end of the range (e.g., about 1 nm to about 1 micron) and the catalyst material comprising a supporting scaffold located in the higher end of the range (e.g., about 5 microns to about 20 microns). The amount of loading of the catalyst material onto a supporting substrate can vary, but will typically be from about 0.2 percent to about 10.0 percent, based on the total dry weight of the coated substrate.

The amount of catalytic metal compound incorporated into the filter element can vary. For example, the amount typically incorporated within a representative filter element can range from about 0.1 mg to about 200 mg. Generally, that amount is at least about 1 mg, and often at least about 5 mg. Typically, the amount does not exceed about 100 mg, and often does not exceed about 90 mg. Frequently, the amount can be from about 5 mg to about 80 mg.

Regarding the use of combinations of catalytic metal compounds, one exemplary combination is a combination of a catalyst metal compound in the form of an oxide with a Group VIIIB catalytic metal compound such as palladium, platinum, rhodium, halides thereof (e.g., palladium chloride or platinum chloride), or nitrates thereof (e.g., palladium nitrate or platinum nitrate). The two components can be separately incorporated into a filter element or pre-mixed prior to incorporation. Generally, the ratio between the amount of Group VIIIB metal (or metal halide or nitrate) to the amount of the second catalyst metal compound ranges from about 1:2 to about 1:10,000, on a weight basis.

The manner in which the smoke-altering material is incorporated into the filter element may vary. For example, the smoke-altering material may be imbedded or dispersed within a section of filter material, such as a fibrous filter material (e.g., cellulose acetate tow), or incorporated into a paper, such as the carbon-containing gathered paper described in U.S. Pat. No. 5,360,023 to Blakley et al. In other embodiments, the filter element may include a compartment in which the smoke-altering material may be placed. In addition, a smoke-altering material can be placed both in a compartment and imbedded in one or more of the sections of filter material, and the smoke-altering material in the optional compartment and the adsorbent imbedded or dispersed in the filter material can be the same or different.

Figure 2:
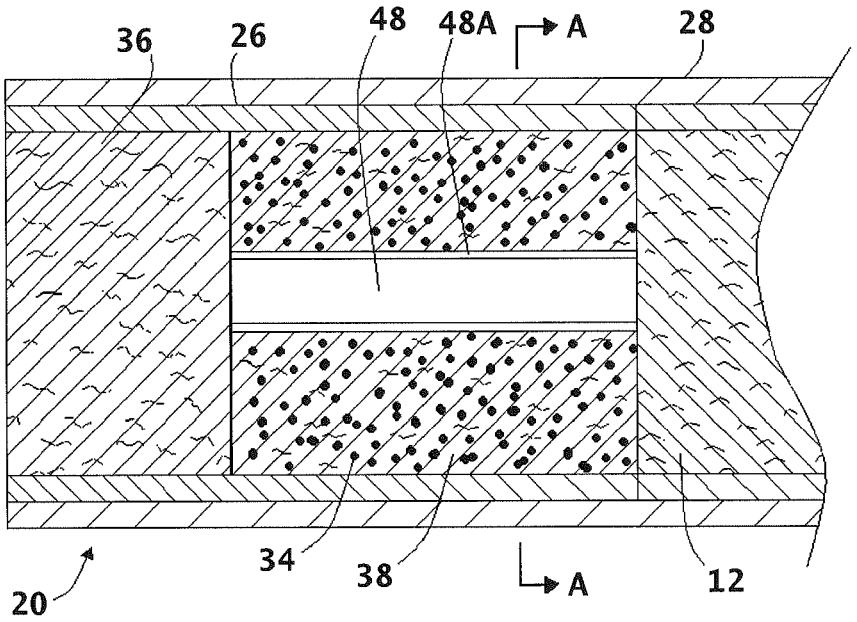
FIG. 2 is a cross-sectional side view of a cigarette of the invention wherein the filter element comprises a first section of filter material proximal to the tobacco rod and a second section of filter material distal to the tobacco rod, the first section of filter material including a smoke-altering material dispersed therein and also including a tube positioned along the central, longitudinal axis thereof extending between the tobacco rod and the second section of filter material.

FIG. 2 illustrates one embodiment of the filter element 20 of the invention comprising a first section of filter material 38 and a second section of filter material 36 arranged in an end-to-end configuration with the first section of filter material. Each of the sections of filter material may independently comprise a fibrous filter material. As shown, the first section of filter material 38 is positioned proximal to the tobacco rod 12 of the filter element 20, and the second section of filter material 36 is positioned distal from the tobacco rod 12 (i.e., at the mouth end of the filter element 20). The first section of filter material 38 includes a smoke-altering material 34, preferably in granular form. Although the smoke-altering material 34 is shown being provided in substantially the entire portion of the first section of filter material 38, in some embodiments, the smoke-altering material 34 may be present in only a defined portion of the first section of filter material 38.

The first section of filter material 38 and the second section of filter material 36 may independently have overall lengths varying from about 5 mm to about 60 mm. In some embodiments, the first section of filter material 38 may have a length of about 7 mm to about 40 mm, about 8 mm to about 35 mm, or about 10 mm to about 30 mm. The second section of filter material 36 may have a length of about 2 mm to about 25 mm, about 4 mm to about 20 mm, or about 6 mm to about 15 mm.

The section of filter material 38 proximal to the tobacco rod 12 comprises one or more tubes 48 with a tube wall 48A extending therethrough, the tube providing a passageway for mainstream smoke passing through the section of filter material 38. Although a tube is illustrated, it is understood that the filter element alternatively can comprise a channel in addition to or in place of the tube. A channel may be characterized as an opening or cavity that is devoid of a filter material. A tube may be characterized as a pre-formed channel. In embodiments wherein tubes are used, the tubes 48 may be characterized as being inserted into and extending through the first section of filter material 38. The one or more tubes (or channels) 48 provide an unimpeded pathway adapted for passage of mainstream smoke between the tobacco rod 12 and the second section of filter material 36 while substantially avoiding contact with the smoke-altering material 34 in the first section of filter material 38. Although not illustrated, it is understood that one or more tubes or channels likewise may be included in the second section of filter material.

As noted previously, the filter element may comprise multiple sections of filter material. For example, returning to FIG. 1, it is possible for the filter element 20 to include a third section of filter material positioned between the tobacco rod 12 and the first section of filter material 38. Further, a cavity could be included in the filter element 20, such as positioned between the first section of filter material 38 and the second section of filter material 36.

Figure 3:
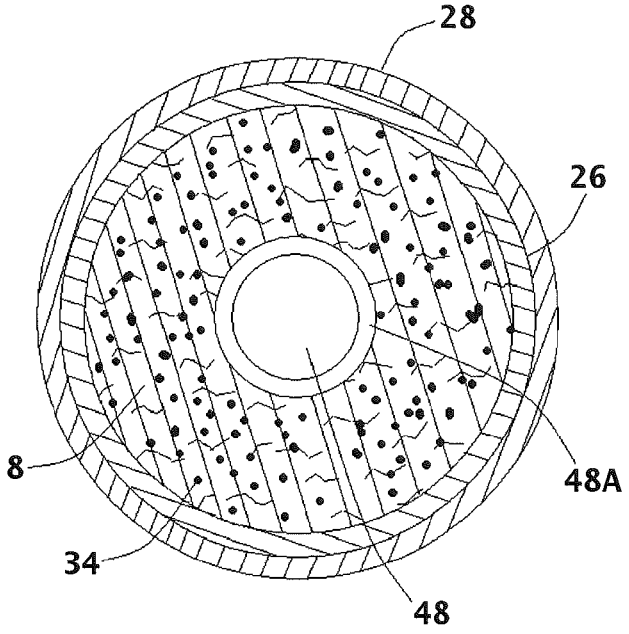
FIG. 3 is a cross-sectional view of the section of the filter element of FIG. 2 taken along line A-A.
Figure 4:
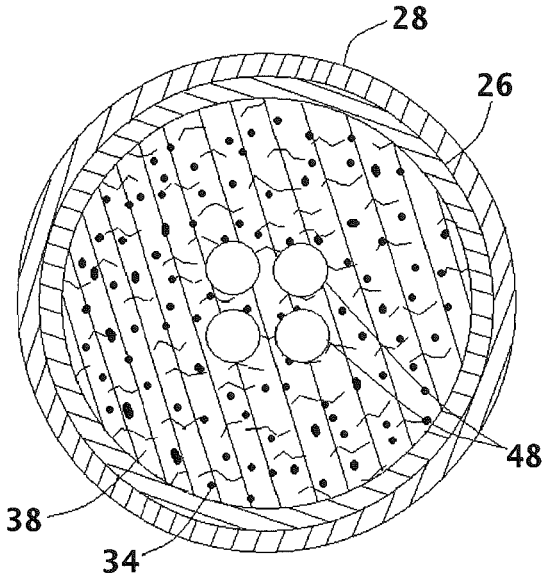
FIG. 4 is a cross-sectional view of a section of the filter element illustrating a channel configuration according to one embodiment of the invention.
Figure 5:
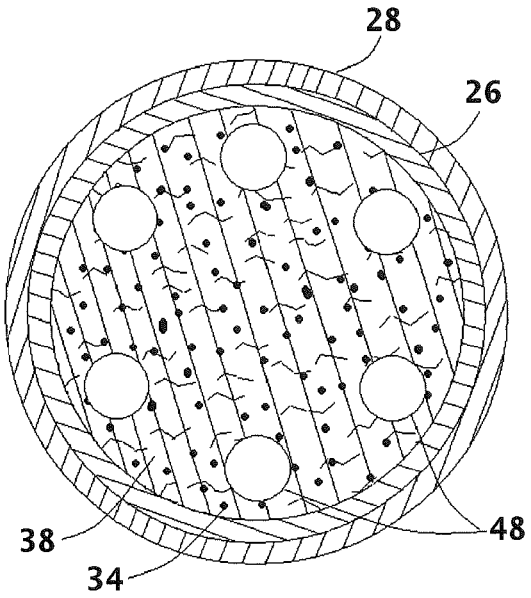
FIG. 5 is a cross-sectional view of a section of the filter element illustrating another channel configuration according to an embodiment of the invention.
Figure 7:
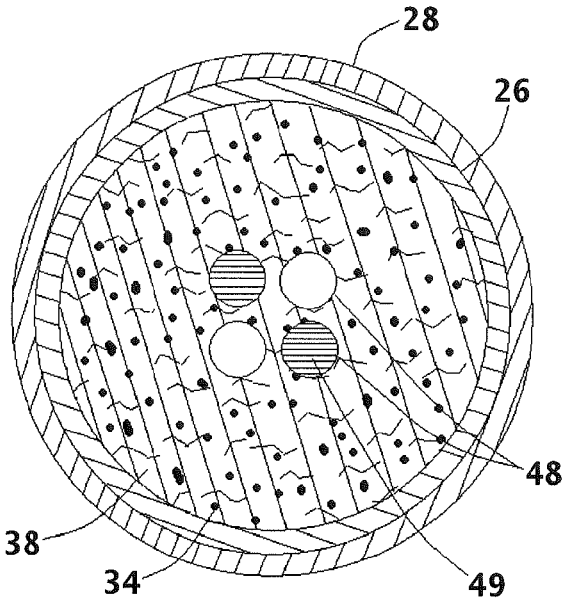
FIG. 7 is a cross-sectional view of a section of the filter element of the invention illustrating still another channel configuration wherein some of the channels are filled with a further filter material.

FIGS. 3-5 illustrate various exemplary configurations for the one or more tubes (or channels) 48 extending through the filter section 38 proximal to the tobacco rod 12. FIG. 3 is a cross-sectional view taken along line A-A in FIG. 2. FIGS. 4, 5, and 7 likewise show cross-sectional views taken along the same line A-A in FIG. 2 but in the respective alternate embodiments. As shown in FIG. 3, the filter element 20 may include a single tube 48 extending along and proximal to, for example, the central axis of the first section of filter material 38. Alternatively, as shown in FIG. 4 and FIG. 5, a plurality of channels (or tubes in other embodiments) 48 may be utilized, although the exact placement and configuration of the multiple channels may vary. In the embodiment of FIG. 4, a plurality of channels 48 are placed proximal to the central axis of the filter section 38. In an alternative embodiment shown in FIG. 5, the plurality of channels 48 are positioned along the periphery of the filter section 38. In one embodiment, the number of channels (or tubes) 48 is 1 to about 20, 1 to about 15, or 1 to about 10 (e.g., 1, 2, 3, 4, 5, 6, 7, 8, 9, or 10 channels).

The walls of the channels 48 may be defined by the material of the section of filter material 38 in which the channels are formed. Alternatively, the channels 48 can be in the form of tubes with walls, the tubes being inserted into or otherwise combined with the filter material. As illustrated in FIG. 3, the tube 48 has a tube wall 48A of defined thickness such that the tubes 48 have an inner diameter and an outer diameter. The tubes (i.e., the tube walls) may comprise any material (e.g., polymeric material) capable of forming self-supporting structures, such as cellulose acetate, polyethylene, polypropylene, PLA, PHA, or combinations thereof.

The total cross-sectional area of the one or more channels or tubes 48 can vary. Typically, the total cross-sectional area of the channels or tubes 48 is about 0.1 $mm^2$ to about 50 $mm^2$, about 0.25 $mm^2$ to about 20 $mm^2$, or about 0.5 $mm^2$ to about 15 $mm^2$. The cross-sectional shape of the channels or tubes 48 may vary and can be, for example, rectangular, circular, or triangular. In certain embodiments, the tubes 48 can have an internal diameter of at least about 0.25 mm, at least about 0.5 mm, or at least about 0.75 mm. In specific embodiments, the tubes can have an internal diameter of about 0.25 mm to about 2 mm, about 0.5 mm to about 1.5 mm, or about 0.6 mm to about 1.25 mm. The tube walls 48A can have a thickness of about 0.1 mm to about 1 mm, about 0.2 mm to about 0.8 mm, or about 0.3 mm to about 0.5 mm. The outer diameter of the tubes 48 may vary depending upon the desired combination of tube internal diameter and tube wall thickness. In embodiments wherein channels are formed without the use of pre-formed tubes, the channel diameter can be in the same ranges noted for the internal diameter of the tubes. In some embodiments (particularly when the channels are not in the form of pre-shaped tubes) the diameter of the channel may be selected so as to prevent migration of the smoke-altering material into the channel or tube (i.e., the diameter of the channel or tube can smaller than the diameter of the particles of the smoke-altering material). In other embodiments, the tube walls may provide sufficient barrier properties so as to substantially prevent such migration, and the internal diameter of the tubes may be independent of the particle size of the smoke-altering material.

Figure 6:
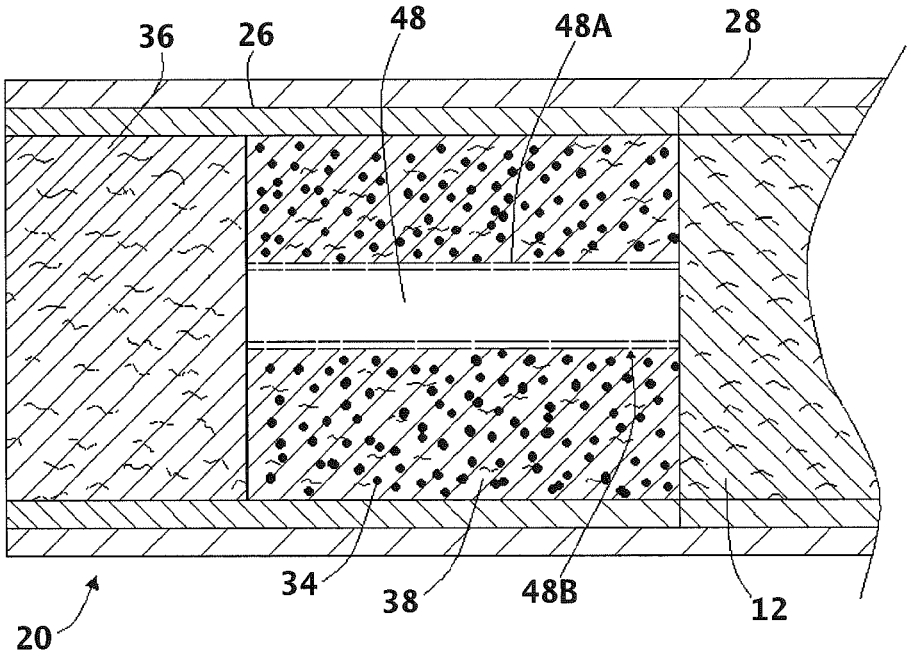
FIG. 6 is a cross-sectional side view of a cigarette according to another embodiment of the invention wherein filter element includes a pre-formed tube with porous tube walls.

In certain embodiments, the walls 48A of the tubes 48 in the first section of filter material 38 may have a defined porosity. Such porosity may arise from the inherent nature of the material used to prepare the tubes. In specific embodiments, as illustrated in FIG. 6, porosity may be achieved (or increased) via provision of perforations 48B that are formed in the tube walls 48A. Specifically, the tube walls may have a sufficient porosity such that at least a portion of the mainstream smoke permeates through the tube walls and into the first section of filter material. The porosity can be defined to limit the amount of mainstream smoke passing through the tubes and avoiding contact with the smoke-altering material present in the first section of filter material.

A further embodiment according to the invention illustrated in FIG. 7 provides for the optional inclusion of a further filter material 49 positioned in and at least partially filling channels or tubes 48. In the embodiment shown the tube filter material 49 is provided in less than all of the tubes 48 present in the first section of filter material 38. In other embodiments, all tubes present may be filled with the further filter material. The further filter material 49 positioned in one or more of the tubes 48 may be the same or different from one or both of the first section of filter material 38 and the second section of filter material 36. In still further embodiments, one or more channels or tubes 48 may be lined with a filter material but still have an open passage extending therethrough. The filter material lining the tubes may be any useful material, and may be the same or different than the filter material surrounding the tubes.

Figure 8:
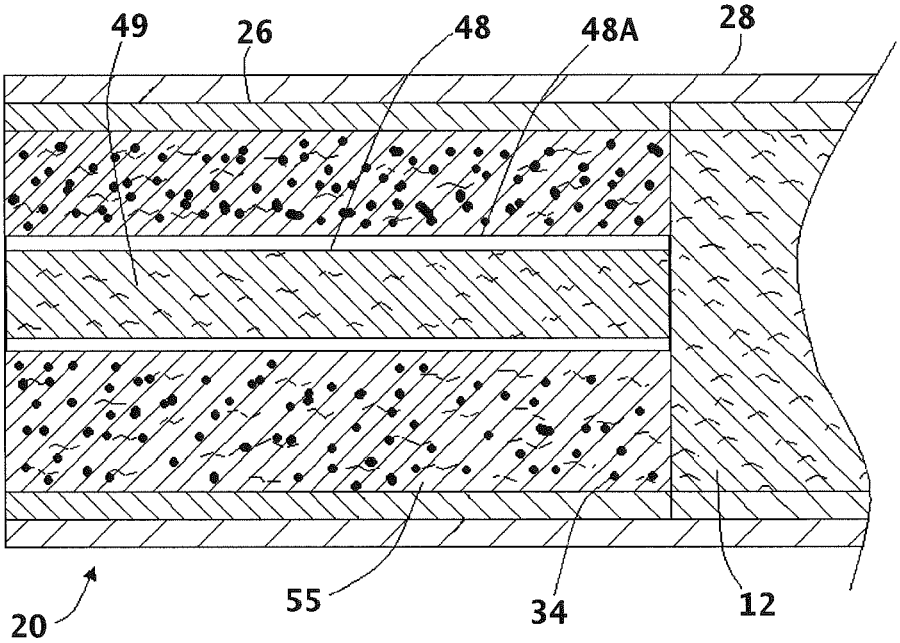
FIG. 8 is a cross-sectional side view of a cigarette of the invention wherein only a single section of filter material extends from the tobacco rod to the ultimate mouth end of the filter element and wherein a tube filled with a further filter material extends through the full length of the filter element.
Figure 9:
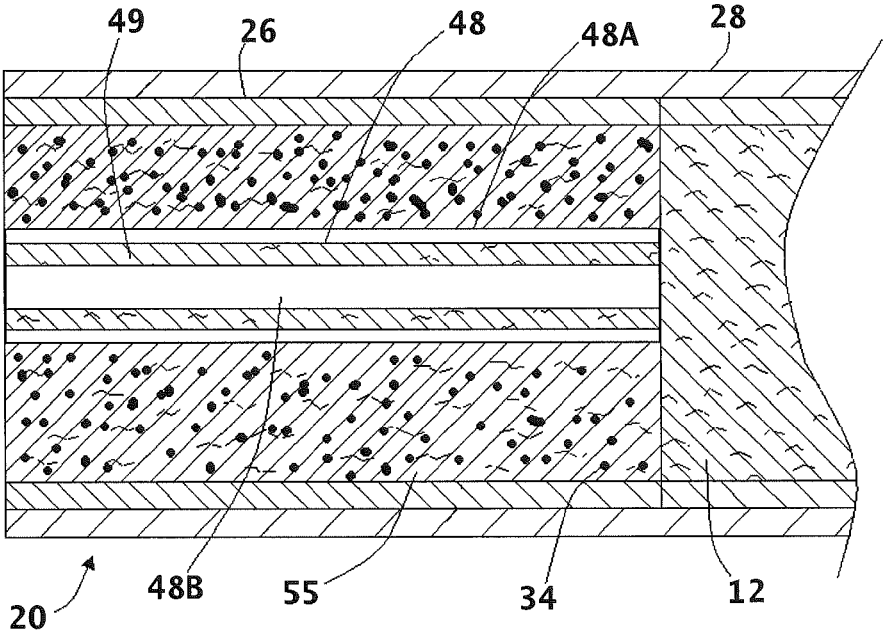
FIG. 9 is a cross-sectional side view of a cigarette of the invention wherein only a single section of filter material extends from the tobacco rod to the ultimate mouth end of the filter element, wherein a tube extends through only a partial length of the filter element, and wherein the smoke-altering material is present only in the portion of the filter element proximal to the tobacco rod.

In still further embodiments illustrated in FIG. 8 and FIG. 9, the filter element 20 may be formed of a single section of filter material 55, which may be formed of any of the materials described herein for use in the sections of filter material in the further embodiments of the invention. In the embodiment of FIG. 8, the tube 48 extends longitudinally the entire length of the section of filter material 55, which further includes the smoke-altering material 34. The tube 48 is filled with a further filter material 49, which may particularly be the same type of material used in the second section of filter material 36 described above. In other embodiments, the tube 48 may be only partially filled with the further filter material 49, or the further filter material may be completely absent (i.e., the tube may be devoid of any filter material and thus be an open channel). In this manner, mainstream smoke exiting the tobacco rod 12 and passing through the tube 48 does not contact the smoke-altering material 34 but still is optionally filtered when the further filter material 49 is present in the tube 48. Preferably, the further filter material 49 would comprise only materials that would not be expected to adversely change the sensory properties of the mainstream smoke.

In the embodiment illustrated in FIG. 9, the tube 48 again extends longitudinally the entire length of the section of filter material 55, which further includes the smoke-altering material 34. The tube 48 still includes a further filter material 49, which may particularly be the same type of material used in the second section of filter material 36 described above. In this embodiment, however, the further filter material 49 only lines the interior of the tube walls 48A so that an unobstructed passage 48B still extends through the entire length of the tube 48. In this manner, mainstream smoke exiting the tobacco rod 12 and passing through the tube 48 does not contact the smoke-altering material 34 but still is filtered by contact with the further filter material 49 lining the walls 48A of the tube 48. Preferably, the further filter material 49 would comprise only materials that would not be expected to adversely change the sensory properties of the mainstream smoke. The subject matter described in relation to FIG. 8 and FIG. 9 also may encompass embodiments wherein pre-formed tubes are not used but rather one or more channels 48 are formed in the single section of filter material 55. For example, in relation to FIG. 9, the passage through the section of filter material 55 could be configured as a formed channel, and the further filter material 49 could line the walls of the formed channel such that mainstream smoke exiting the tobacco rod 12 and passing through the channel still does not contact the smoke-altering material 34.

Figure 10:
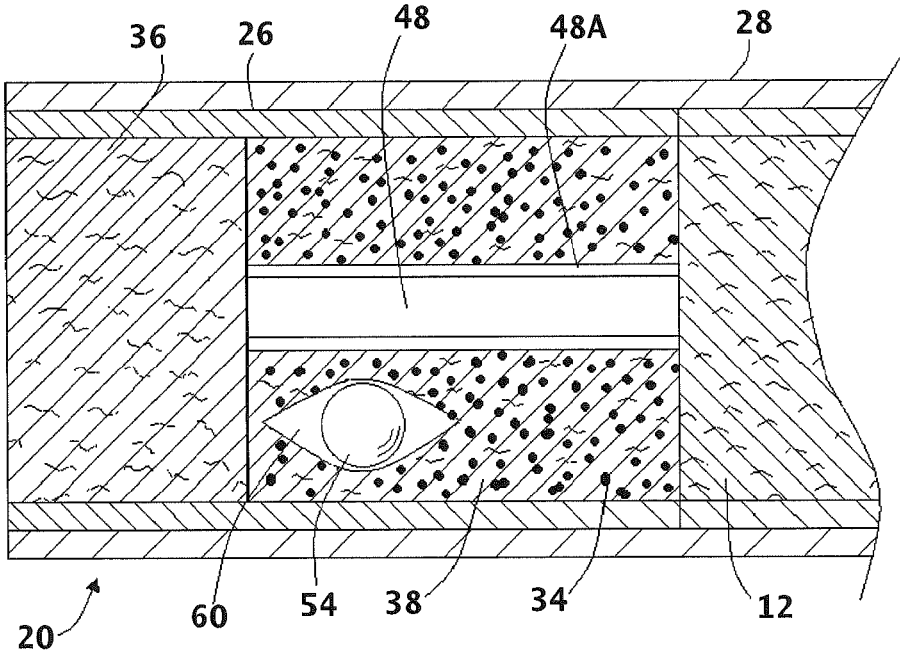
FIG. 10 is a cross-sectional side view of a cigarette of the invention wherein the filter element includes a pre-formed tube with solid tube walls extending through the section of filter material proximal to the tobacco rod, and wherein the filter element further includes a breakable capsule therein.

In a further embodiment illustrated in FIG. 10, the filter element 20 includes at least one breakable capsule 54 in the first section of filter material 38. The capsule 54 can be simply imbedded in the filter material 38. In the embodiment shown in FIG. 10, the section of filter material 38 includes a compartment 60 therein adapted for receiving the breakable capsule 54. Such compartment 60 may arise simply from the action of the capsule 54 being physically inserted into the filter material 38. In alternate embodiments, the breakable capsule may be provided in the second section of filter material 36, the single section of filter material 55, or in the channel (or tube) 48. When the breakable capsule is provided in the channel, it can be preferable for the channel to be formed within the section of filter material rather than being a pre-formed tube so as to facilitate ease of breaking of the capsule.

Each breakable capsule 54 carries a payload incorporating a compound that is intended to introduce some change to the nature or character of mainstream smoke drawn through that filter element (e.g., a flavoring agent). The smoker may selectively rupture the capsule 54 in order to release the flavoring agent. In specific embodiments, the use of a breakable capsule 54 containing a flavoring agent downstream of the smoke-altering material 34 can provide the smoker with the ability to compliment taste attributes of the smoking article. When the flavoring agent contained in the capsule 54 is downstream of the smoke-altering material 34, there is minimal interaction with the smoke-altering material. Methods of manufacturing filter elements having a breakable capsule 54 therein are described in U.S. Pat. No. 7,836,895 to Dube et al., which is incorporated by reference herein.

The tipping material 28 connecting the filter element 20 to the tobacco rod 12 can have indicia (not shown) printed thereon. For example, a band (not shown) can indicate to a smoker the general location or position of the capsule 54 within the filter element 20. These indicia may help the smoker to locate the capsule 54 so that it can be more easily ruptured by squeezing the filter element 20 directly outside the position of the capsule. The indicia on the tipping material 28 may also indicate the nature of the payload carried by the capsule 54. For example, the indicia may indicate that the particular payload is a spearmint flavoring by having a particular color, shape, or design.

If desired, the smoker may rupture the capsule 54 at any time before, during, or even after, the smoking experience. Breakage of the capsule 54 acts to release the contents that are contained and sealed therein. Release of the contents of the capsule 54 into the filter element 20 thus enables the smoker to achieve the intended benefit of action of certain of those contents, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, in highly preferred embodiments, a portion of the payload (e.g., portions of a flavoring agent) that has been released into the filter element 20 is incorporated into each subsequent puff of mainstream smoke that is received through that filter element.

Application of tactile pressure to the capsule 54, for example by a squeezing action provided by the fingers of the smoker to the filter element 20, causes relevant regions of the filter element to deform and hence causes the capsule to rupture and release its payload to the compartment interior 60 of the filter element. The rupture of the capsule 54 can be discerned by an audible pop, snap, or a rapid decrease in the resistance to the pressure applied by the smoker. Rupture of the capsule 54 causes contents of its payload to disperse throughout the compartment 60 and throughout the filter tow material. Most preferably, the overall cylindrical shape of the filter element 20 returns to essentially its original shape after the application of pressure to the filter element is ceased. In other embodiments, the capsule 54 may be rupturable by means in addition to or other than application of pressure. For example, the capsule could be formed of a material that ruptures do to contact by vapor phase materials in the smoke drawn through the filter tow material, such as water vapor. Further, the capsule could be formed of a material that ruptures do to an increase in temperature associated with the passage of the smoke through the filter tow material.

In embodiments wherein a compartment 60 is present to house the capsule 54, such compartment may have a generally circular and/or conical cross-sectional shape and have a diameter of about 3 mm to about 4 mm at its widest point. The walls of the compartment 60 may be defined by compressible and deformable material (e.g., plasticized cellulose acetate), and the compartment may be manufactured so as to have a greater or smaller diameter.

The filter element 20 may include one or more capsules 54 having diameters of at least about 1 mm, typically at least about 2 mm, and often at least about 3 mm. Typically, the capsules 54 have diameters that do not exceed about 6 mm, often do not exceed about 5 mm, and frequently do not exceed about 4.5 mm. Certain preferred capsules 54 have diameters in the range of about 3 mm to about 4 mm in diameter, and certain highly preferred capsules are approximately 3.5 mm in diameter. In some embodiments, capsules 54 may be associated with the tube walls 48A. For example, capsules 54 could be imbedded within the tube walls 48A or could line the interior and/or exterior surfaces of the tube walls 48A. In such embodiments, even smaller capsules—e.g., microcapsules—could be used.

The capsule 54 can be generally spherical in shape and possess a rigid outer shell, such as a gelatin outer shell, that surrounds an internal payload. Suitable capsules are commercially available from Mane Aromatic Flavors, located in Nice, France as gelatin encapsulated mixtures of medium chain triglycerides and flavor agents. The designations of a number of flavor capsules that are available from Mane Aromatic Flavors are: Spearmint, E209123; Cinnamon, E0303392; Russian Tea, E0303386; Lemon, E127382; and Menthol, E127384. Such representative capsules 54 have diameters of about 3.5 mm and about 4 mm.

The outer shell of the capsule 54 is preferably constructed of a food grade gelatin derived from bovine, piscine or porcine stock. A wide variety of gelatins may be used, and the selection of a gelatin for the capsule outer surface is considered a matter of design choice to those of ordinary skill in the art. See, Kirk-Othmer, *Encyclopedia of Chemical Technology*, ($4^{th}$ Ed.) 12, 406-416 (1994), which is incorporated herein by reference. The type of gelatin used for constructing the outer shell of the capsule provides that capsule with the capability of being exposed to triacetin (a common plasticizer used in cigarette filter manufacture) or 1,2 propylene glycol (a common tobacco casing component) for relatively long periods of time without experiencing undesirable interaction (e.g., dissolution of the gelatin therein). Because the gelatins used in the preferred embodiments may dissolve in water over extended periods of time, it is desirable to employ virtually anhydrous payloads (or payloads possessing very low amounts of water) with capsules having gelatin outer coatings.

The capsule payload can have a form that can vary; and typically, the payload has the form of a liquid, a gel, or a solid (e.g., a crystalline material or a dry powder). The payload can incorporate components that aid in flavoring or scenting mainstream cigarette smoke. Alternatively, the payload may be a breath freshening agent for the smoker, a deodorizing agent for the cigarette butt, a moistening or cooling agent for the cigarette smoke, or a composition capable of otherwise altering the nature or character of the cigarette.

In the preferred embodiment, the payload is a mixture of a flavoring and a diluting agent or carrier. The preferred diluting agent is a triglyceride, such as a medium chain triglyceride, and more particularly a food grade mixture of medium chain triglycerides. See, for example, Radzuan et al., *Porim Bulletin,* 39, 33-38 (1999). Flavorings of the payload may be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., *Tobacco Flavoring for Smoking Products*, R. J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule as a mixture, or as components of multiple capsules positioned within the filter element.

The amount of flavoring and diluting agent within the capsule 54 may vary. In some instances, the diluting agent may be eliminated altogether, and the entire payload can be composed of flavoring agent. Alternatively, the payload can be almost entirely comprised of diluting agent, and only contain a very small amount of relatively potent flavoring agent. In the preferred embodiment using a capsule of, for example, approximately 3.5 mm in diameter, the weight of the liquid payload (e.g., flavoring agent and diluting agent) is preferably in the range of about 15 mg to about 25 mg, and more preferably in the range of about 20 mg to about 22 mg. The preferred composition of the mixture of flavoring and diluting agent is in the range of about 5 percent to about 25 percent flavoring, and more preferably in the range of about 10 to about 15 percent flavoring, by weight based on the total weight of the payload, with the balance being diluting agent.

The above filter element 20 embodiments are not mutually exclusive, meaning that aspects of more than one filter embodiment may be combined to further enhance the properties of the filter. For example, a filter combining one or more channels or tubes can also comprise one or more breakable capsules.

In the embodiments described above, the first section of filter material 38, the second section of filter material 36, and the single section of filter material 55 may comprise any filter material capable of filtering particulate matter entrained in mainstream smoke generated by a smoking article. Exemplary filter materials include cellulose acetate tow, gathered cellulose acetate web, polypropylene tow, gathered polypropylene web, gathered polyester web, gathered paper, and strands of reconstituted tobacco. In preferred embodiments, each section of filter material comprises a fibrous filter material, such as cellulose acetate tow.

The sections of filter material may further include a plasticizing component, such as triacetin or carbowax. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight.

The particulate removal efficiency of each segment of filter material in the filter element can vary. For fibrous filter materials, particulate removal efficiency is preferably quantified in terms of weight per unit length of the filaments forming the fibers. Exemplary filter materials incorporate materials having a size of about 1.8 to about 10 denier per filament (dpf). Each filter segment in a multi-segment filter element can have the same or different filtration efficiency and can use the same or different materials. In one embodiment, the section of filter material 38 proximal to the tobacco rod 12 has a higher particulate removal efficiency than the section of filter material 36 distal from the tobacco rod. In other embodiments, the section of filter material 38 proximal to the tobacco rod 12 has a lower particulate removal efficiency than the section of filter material 36 distal from the tobacco rod. In certain embodiments, the filaments of the tobacco end section of filter material 38 can have a weight per unit length of about 1.8 dpf to about 8 dpf, about 2 dpf to about 7 dpf, or about 2 dpf to about 6 dpf. In other embodiments, the filaments of the mouth end section of filter material 36 can have a weight per unit length of about 2 dpf to about 10 dpf, about 2.5 dpf to about 9 dpf, or about 3 dpf to about 8 dpf.

EXPERIMENTAL

The following example is provided to illustrate embodiments of the present invention, and should not be considered to limit the scope of the invention or the claims appended hereto. Unless otherwise noted, all parts and percentages are by weight. The cigarettes so described in the example can be handmade or manufactured by machine using, for example, a Pilot Cigarette Maker from Hauni-Werk Korber & Co. KG.

A cigarette is prepared using a representative American blend comprising about 24 percent flue-cured tobacco, about 13 percent Turkish or Oriental lamina, about 19 percent burley tobacco, about 3 percent burley casing, about 17 percent reconstituted tobacco, about 15 percent DIET, about 2.5 percent shorts, about 4 percent total casing, and about 2% top dressing.

The tobacco blend is used to prepare a cigarette ("Control Cigarette") having a length of about 83 mm. The tobacco rod length is about 56 mm and the filter element length is about 27 mm. The tobacco rod includes a charge of about 0.66 g of tobacco cut filler contained in a circumscribing cigarette paper wrap of the type that is available as FSC commercial paper manufactured by Schweitzer-Mauduit International, Inc. The tipping material circumscribes the length of the filter element and extends about 4 mm down the length of the tobacco rod. A ring of laser perforations is provided around the periphery of each cigarette about 13 mm from the extreme mouth-end thereof. The perforations penetrate through the tipping paper and plug wrap, and can be provided using a Laboratory Laser Perforator from Hauni-Werk Korber & Co. KG.

The filter element of the Control Cigarette is a 27 mm mono cellulose acetate tow with 7% triacetin. The tow has a fiber size of 2.5 dpf and 30,000 total denier. The Control Cigarette is air diluted to about 30-33 percent and includes no smoke-altering material that may affect the sensory characteristics of the mainstream smoke. The Control Cigarette yields about 10.3 mg "tar", 0.86 mg nicotine, and 10.5 mg CO when smoked under FTC smoking conditions.

A cigarette ("Comparative Cigarette") is provided as described above. The Comparative Cigarette differs from the Control Cigarette in that the filter element of the Comparative Cigarette has the general configuration as shown in FIG. 2 but with the tube being absent. The Comparative Cigarette has a filter element comprising a 7 mm mouth-end cellulose acetate tow segment with 7% triacetin and a 20 mm cellulose acetate tow tobacco-end segment with 6% triacetin and 84 mg granular carbon available as G277M (85 carbon tetrachloride activity and size 20×50 mesh) from PICA. The mouth-end section tow has a fiber size of 2.3 dpf and 35,000 total denier. The tobacco-end segment tow has a fiber size of 3.9 dpf and 30,000 total denier. The cigarette yields about 10.9 mg tar, 0.93 mg nicotine, and 10.8 mg CO when smoked under FTC smoking conditions.

The Comparative Cigarette made with the dual dalmation filter segment having the smoke-altering material proximal to the tobacco rod provides a reduction in certain volatile and semi-volatile mainstream smoke components as compared to the Control Cigarette when smoked under FTC smoking conditions. The Comparative Cigarette provides about 50 percent reduction of acrylonitrile, about 78 percent reduction of pyridine, about 44 percent reduction of acetaldehyde, about 71 percent reduction of acetone, about 72 percent reduction of acrolein, about 18 percent reduction of formaldehyde, about 78 percent reduction of benzene, about 44 percent reduction of 1,3-butadiene, about 20 percent reduction in ethylene oxide, about 50 percent reduction of isoprene, about 45 percent reduction of propylene oxide, and about 64 percent reduction in hydrogen cyanide.

A cigarette ("Inventive Cigarette 1") is provided with the same general construction of the Comparative Cigarette but also including the tube illustrated in FIG. 2. In particular, the cellulose acetate tow tobacco-end segment includes a cellulose acetate tube available from Filtrona Greensboro, Inc., the tube having an internal diameter of 0.58 mm, a tube wall thickness of 0.4 mm, and an outer diameter of 1.38 mm. The tube extends longitudinally the entire 20 mm length of the tobacco-end segment. The mouth-end section tow has a fiber size of 5.0 dpf and 39,000 total denier. The tobacco-end segment tow has a fiber size of 3.3 dpf and 30,000 total denier. Inventive Cigarette 1 yields about 11.4 mg tar, 0.98 mg nicotine, and 11.2 mg CO when smoked under FTC smoking conditions. The cigarette of Example 3 provides about 50 percent reduction of acrylonitrile, about 55 percent reduction of pyridine, about 31 percent reduction of acetaldehyde, about 57 percent reduction of acetone, about 56 percent reduction of acrolein, about 6 percent reduction of formaldehyde, about 63 percent reduction of benzene, about 35 percent reduction of 1,3-butadiene, about 20 percent reduction in ethylene oxide, about 44 percent reduction of isoprene, about 32 percent reduction of propylene oxide, and about 60 percent reduction in hydrogen cyanide in comparison to the Control Cigarette.

A cigarette ("Inventive Cigarette 2") is provided with the same general construction as Inventive Cigarette 1. In particular, the cellulose acetate tow tobacco-end segment includes a cellulose acetate tube having an internal diameter of 0.76 mm, a tube wall thickness of 0.4 mm, and an outer diameter of 1.56 mm. The tube extends longitudinally the entire 20 mm length of the tobacco-end segment. The mouth-end section tow has a fiber size of 5.0 dpf and 30,000 total denier. The tobacco-end segment tow has a fiber size of 3.0 dpf and 40,000 total denier. Inventive Cigarette 2 yields about 11 mg tar, 0.92 mg nicotine, and 11 mg CO when smoked under FTC smoking conditions. The Inventive Cigarette 2 provides about 50 percent reduction of acrylonitrile, about 22 percent reduction of pyridine, about 30 percent reduction of acetaldehyde, about 50 percent reduction of acetone, about 50 percent reduction of acrolein, about 57 percent reduction of benzene, about 33 percent reduction of 1,3-butadiene, about 20 percent reduction in ethylene oxide, about 39 percent reduction of isoprene, about 26 percent reduction of propylene oxide, and about 48 percent reduction in hydrogen cyanide in comparison to the Control Cigarette.

The Control Cigarette, Comparative Cigarette, Inventive Cigarette 1, and Inventive Cigarette 2 are compared using a Non-Menthol Descriptive Evaluation panel. The panel evaluates 31 attributes using a regular Non-Menthol ballot. Data collection is conducted using the SIMS2000 data collection software. Lit cigarettes are evaluated as follows: after the lighting puff and two additional puffs, the evaluator rates the first two attributes, takes a puff and rates the next two attributes, and repeats the cycle of a puff followed by rating two attributes until the lit evaluation is complete. The respondent also is actively smoking the product as the evaluations are being made. The aftertaste characteristics are evaluated after a 60 second break. Each test respondent completes three replicate monadic evaluations of each cigarette. Water and unsalted crackers are used between cigarettes, and a 12 minute break separates cigarette evaluations. The following characteristics are evaluated: early draw; early harshness; tobacco; papery/woody; ashy; chemical; dirty/earthy; musty; metallic; bitter; sweet; mouth sensation; drying sensation; coating sensation; late harshness; late draw; overall flavor; tobacco aftertaste; papery/woody aftertaste; ashy aftertaste; chemical aftertaste; dirty/earthy aftertaste; musty aftertaste; metallic aftertaste; bitter aftertaste; sweet aftertaste; mouth sensation after evaluation; drying sensation after evaluation; coating sensation after evaluation; throat sensation after evaluation; and overall aftertaste.

Significant differences were noted with the Comparative Cigarette, Inventive Cigarette 1, and Inventive Cigarette 2 on 19 of the 31 attributes tested as compared to the Control Cigarette. The results demonstrated that the Comparative Cigarette, Inventive Cigarette 1, and Inventive Cigarette 2 were perceived as having less taste and sensation characteristics when compared to the Control Cigarette that did not include any smoke-altering material in the filter element. The inclusion of the tube element, particularly the larger inner diameter tube in Inventive Cigarette 2, resulted in a reduced loss of taste and sensation characteristics compared to the Comparative Cigarette, which included the smoke-altering material and no tube. Overall, the sensory results indicate that tube-in-tow filter elements are useful to reduce the bland taste often characteristic of cigarettes that are filtered using a smoke-altering material, such as carbon, and the results indicate that the "tube-in-tow" filter elements can yield more intense (or less bland) taste and sensory perceptions while maintaining desired removal efficiencies of vapor phase compounds.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An article comprising a tobacco rod and a filter element connected to the tobacco rod, said filter element having an end proximal to the tobacco rod and an end distal from the tobacco rod defining a mouth end of the article, wherein said filter element comprises a first section of filter material with a plurality of channels formed therein and extending at least partially longitudinally through the first section of filter material, said plurality of channels each being adapted for passage of mainstream smoke between said tobacco rod and a second section of filter material arranged in an end-to-end configuration with said first section of filter material, the first section of filter material comprising a gathered polyester web and a smoke-altering material comprising a flavorant and the second section of filter material comprising cellulose acetate, wherein a filter material comprising cellulose acetate is positioned in at least one of said plurality of channels of said first section of filter material.

2. The article of claim 1, wherein the total cross-sectional area of said plurality of channels is about 0.1 $mm^2$ to about 50 $mm^2$.

3. The article of claim 1, wherein each of said plurality of channels has an internal diameter of about 0.25 mm to about 2 mm.

4. The article of claim 1, wherein the tobacco rod comprises an aerosol forming material.

5. The article of claim 4, wherein the aerosol forming material comprises a polyol.

6. The article of claim 4, wherein the aerosol forming material is present in an amount of about 10 weight percent to about 50 weight percent, based on the combined dry weight of the aerosol forming material and tobacco material.

7. The article of claim 4, wherein the tobacco rod comprises reconstituted tobacco.

8. The article of claim 7, wherein the reconstituted tobacco is manufactured using paper-making type or cast sheet type processes.

9. The article of claim 1, wherein the flavorant is menthol.

10. The article of claim 1, wherein the article is an aerosol-generating smoking article that does not combust tobacco.

11. The article of claim 1, wherein the plurality of channels in the first section of filter material include a plurality of channels positioned along the periphery of the first section of filter material.

* * * * *